United States Patent [19]

DeHart

[11] 4,039,136

[45] Aug. 2, 1977

[54] WALL MOUNTABLE AND MOLDING MOUNTABLE BRACKET

[76] Inventor: Damon H. DeHart, 6 Veterans Lane, Stoneham, Mass. 02180

[21] Appl. No.: 625,530

[22] Filed: Dec. 17, 1975

Related U.S. Application Data

[63] Continuation-in-part of Ser. No. 524,548, Nov. 18, 1974, abandoned.

[51] Int. Cl.[2] ..... E04G 3/00

[52] U.S. Cl. ..... 248/215; 248/227; 248/301

[58] Field of Search ..... 248/215, 217, 227, 301, 248/304, 218

[56] References Cited

U.S. PATENT DOCUMENTS

| | | | |
|---|---|---|---|
| 712,492 | 11/1902 | Broga | 248/215 |
| 1,294,916 | 2/1919 | Knight | 248/215 |
| 1,547,350 | 7/1925 | Rosenblum | 248/215 |
| 2,150,826 | 3/1939 | Gill | 248/215 |
| 2,955,794 | 10/1960 | Robbins | 248/215 |
| 3,536,287 | 10/1970 | Kramer | 248/215 |
| 3,814,359 | 6/1974 | Powell | 248/215 |

FOREIGN PATENT DOCUMENTS

| | | | |
|---|---|---|---|
| 365,734 | 1/1932 | United Kingdom | 248/227 |

*Primary Examiner*—Robert A. Hafer

[57] ABSTRACT

An improved bracket which can be mounted to walls with conventional fasteners such as screws or nails, and also can be mounted to wall molding by a detachable hook assembly which hooks over the top surface of the wall molding and enters between the back surface of the wall, thus eliminating the need for conventional fasteners, such as screws or nails.

3 Claims, 2 Drawing Figures

WALL MOUNTABLE AND MOLDING MOUNTABLE BRACKET

This application is a continuation in part of my copending U.S. application, Ser. No. 524,548, filed Nov. 18, 1974, now abandoned.

This invention relates to the improvement in brackets and more particularly to the brackets which are mounted to walls and to wall molding. Most methods of mounting a bracket to a wall or to wall molding employ conventional fasteners such as screws or nails, which result in holes being put into the wall or wall molding.

The object of this invention is to provide a bracket which can be mounted to a wall with conventional fasteners, and can also be mounted to wall molding by means of a hook assembly which can be detachably fastened to the bracket without the use of tools and can be used to attach the bracket to the wall molding without the need for putting holes in the wall molding for conventional fasteners.

Another object is to simplify and hasten the removal of the mounted bracket from the wall molding.

The embodiment of this invention together with the modifications are illustrated in the accompanying drawings.

Figure 1:
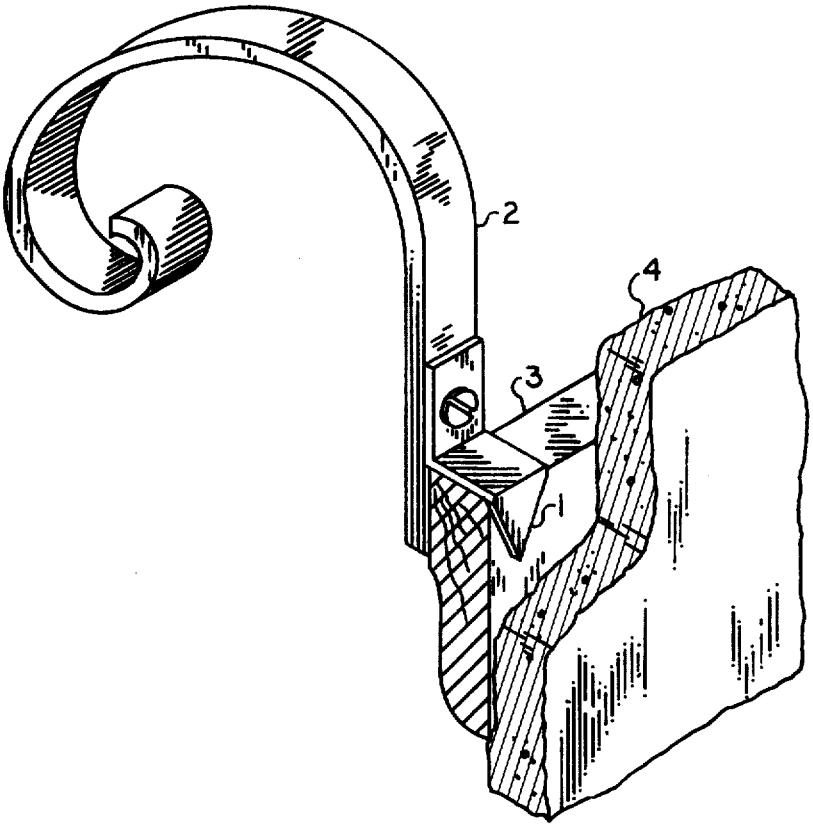
FIG. 1 is a perspective view of the invention showing an improved bracket mounted to a wall molding by a hook assembly which incorporates one form of the fastener means.
Figure 2:
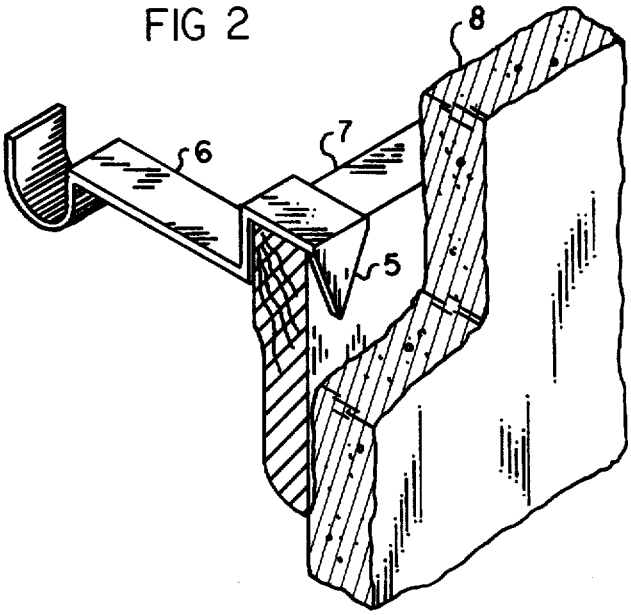
FIG. 2 is a perspective view of the invention showing a hook assembly which incorporates another form of the fastener means.

With more detailed reference to the drawings wherein like reference characters denote corresponding parts, the numeral 1 designates the bracket which can be made from a strong material such as steel and produced by a process such as forming. The wall, 6, is a typical wall. The wall molding, 7, is a typical wall molding. The tang, 8, is made from a strong material such as steel and is produced by a process such as stamping. The retainer, 9, is made from a strongmaterial such as steel and is produced by a process such as stamping. The tang, 10, and retainer, 11, are made from a strong material such as steel and are produced by a process such as stamping.

In order to mount bracket, 1, to a wall, 6, a conventional fastener is inserted through hole, 5, into wall, 6. Loop, 2, is provided to suspend any desired item.

In order to mount bracket, 1, to a wall molding, 7, the retainer, 9, is slipped onto the straight section, 4, until it butts against mechanical step, 3, Tang, 8, is then inserted into retainer, 9. Tang, 8, is finally pressed into the joint between wall, 6, and wall molding, 7.

In order to mount bracket, 1, to a wall molding, 7, the retainer, 11, is slipped onto the straight section, 4, until it butts against mechanical stop, 3. Tang, 10, is finally pressed into the joint between wall, 6, and wall molding, 7.

What is claimed is:

1. A wall bracket arrangement comprising:

an elongated bracket means having two end portions, said bracket means having a loop at one end portion for suspending an article therefrom said loop being outwarding displaced from the other end portion, said other end portion comprising a depending straight section to abut a wall, said depending straight section having at least one hole to receive a conventional fastener therethrough and stop means to limit a retainer collar means;

detachable thin bodied tang means comprising an outboard depending tang element adapted for insertion between a extending from said tang portion towards said straight section wall and a wall molding, a horizontal middle portion a third portion extending from the end of said middle portion opposite said tang to space said tang element from the depending straight section of said bracket means; and a third portion extending from the end of said middle portion opposite said tang retainer collar means to affix tang means to the depending straight section of said bracket means, said retainer collar means being slidably attachable to said straight section of said bracket means and being adapted to hold said depending straight section and said third portion of said tang means in engagement while abutting said stop means.

2. The wall bracket arrangement of Claim 1 wherein said retainer collar means and defines said third portion thereof is integral with said tang means.

3. The wall bracket arrangement of Claim 1 wherein said stop means comprises a shoulder between said straight section and said end portion comprising said loop.

* * * * *